US005447308A

United States Patent [19]

Girard

[11] Patent Number: 5,447,308

[45] Date of Patent: Sep. 5, 1995

[54] DEFENSIVE POLICE BATON

[76] Inventor: Edward W. Girard, 2600 Chaucer, St. Louis, Mo. 63114

[21] Appl. No.: 216,350

[22] Filed: Mar. 23, 1994

[51] Int. Cl.[6] ..... F41B 15/02

[52] U.S. Cl. ..... 273/84 R; 482/109

[58] Field of Search ..... 273/84 R, 84 A, 84 ES; 482/44, 45, 46, 109, 139; 280/304.3, 304.4, 288.4; 74/551.8, 551.9; D21/198, 210; D22/117, 118

[56] References Cited

U.S. PATENT DOCUMENTS

| | | | |
|---|---|---|---|
| D. 176,579 | 1/1956 | Kraver | 74/551.8 |
| 568,024 | 9/1896 | Gorman | 74/551.8 |
| 3,385,601 | 5/1968 | Black | 273/84 R |
| 4,141,567 | 2/1979 | Scott | 280/304.3 |
| 4,522,398 | 6/1985 | Swartz et al. | 273/84 R |
| 4,643,417 | 2/1987 | Nieman | 482/46 |
| 5,076,578 | 12/1991 | Askonen | 482/139 |

*Primary Examiner*—Vincent Millin
*Assistant Examiner*—William M. Pierce
*Attorney, Agent, or Firm*—Michael I. Kroll

[57] ABSTRACT

A defensive tool for law enforcement officers is disclosed. The device has two gripping portions at its distal ends, which also serve as hand/arm protectors and striking surfaces. Extending between these two areas is a generally cylindrical necked down portion that is surrounded by a rotatable sleeve to prevent a person being apprehended or subdued from gripping and removing the device from the officer's grasp.

1 Claim, 2 Drawing Sheets

DEFENSIVE POLICE BATON

BACKGROUND OF THE INVENTION

REFERENCE TO RELATED PUBLICATIONS

The present invention was registered in the United States Patent and Trademark Office under the Document Disclosure Program. The date received was Jul. 19, 1993 and the registration number is 335,806.

1. Field of the Invention

The present invention relates to defensive weapons for law enforcement officers. More specifically, it relates to a defensive weapon having two distal ends comprising striking or battering surfaces, which also serve as hand grips and hand/arm protectors, and, additionally, has extended between these two distal ends a generally cylindrical necked central portion covered by a rotatable sleeve to prevent an attacker from gripping the device.

2. Description of the Prior Art

Law enforcement officers on the street are forced to react to a mind boggling array of situations. From babysitting to apprehending armed suspects, the duties expected of them are various and cannot be predicted. In situations where the life of the officer or any surrounding civilians is not in danger and yet a suspect needs to be subdued, the most common device available for the subjugation of the person is the "night stick". Another, more recently developed tool is the baton-like device with the rotatable side mounted handle. In the use of both of these devices, one of the drawbacks is that serious injury can be caused the suspect when the device is swung to subdue, due to the high speed attained by the distal end of the device. In many well known cases, lawsuits have been instigated by suspects for use of unnecessary force during apprehension, and these have led to large settlements. What is needed, then, is a device for use by police officers and the like that serves the purpose of protecting the officer, while, when used properly, cannot impose accidental serious injury on the person who is either attacking the officer or being subdued by them. In a search conducted in this field, a number of patents were found that relate to applicant's present invention and they are discussed hereinafter.

First is U.S. Pat. No. 897,201 issued to James T. Gannon on Aug. 25, 1908. In this disclosure there is taught a flexible policeman's club that includes a stiff handle with a rod located in a central longitudinal bore. This rod has a cone shaped extension that cooperates with a plurality of balls or spheres forward thereof in the flexible portion of the club such that the automatic return of the club is assured from the flexed position. This is clearly unlike applicant's present invention in that no hand guard or guards are disclosed.

In U.S. Pat. No. 3,106,398 issued on Oct. 8, 1963 to Milton Allen Gowdet there is disclosed a police weapon wherein a central knurled grip area has adjacent to both of its sides an annular V-shaped groove and, beyond that, a pair of sharp pointed ends. This is clearly unlike the present invention in that neither a guard or guards, as discussed above, is disclosed.

Next is U.S. Pat. No. 3,944,226 issued to Paul D. Starett on Mar. 16, 1976. This discloses a police club wherein an elongate stick having a circular cross section has a protruding annular shoulder to both keep the club from slipping in the officer's belt and also to prevent objects from sliding down the club and hitting the officer's hand. This is unlike applicant's invention in that, as in the two patents discussed above, there is no surrounding guard for the gripping hand.

Lastly, U.S. Pat. No. 4,622,398 issued on Jun. 11, 1985 to Franklin J. Swartz discloses a police baton that is designed to be gripped in the center. This in itself makes it dissimilar from applicant's present invention.

Although certain similarities between the prior patents, directed generally toward solving the aforementioned problem, and the instant invention are seen to exist, it is believed the unique novel features and improvements herein rise to the level of patentable distinction. For example, none of the prior art is suitable for use as a baton providing complete protection for the hands as well as twist prevention means.

None of the above inventions and patents, taken either singly or in combination, is seen to describe the instant invention as claimed.

SUMMARY OF THE INVENTION

The present invention is a defensive tool for law enforcement officers. The device has two gripping portions at its distal ends, which also serve as hand/arm protectors and striking surfaces. Extending between these two areas is a generally cylindrical necked down portion that is surrounded by a rotatable sleeve to prevent a person being apprehended or subdued from gripping and removing the device from the officer's grasp.

Accordingly, it is a principle object of the invention to provide a defensive tool for law enforcement personnel wherein the device includes gripping means at either end, including striking surfaces that additionally protect the hands of the user.

It is another object of the invention to provide a defensive tool for law enforcement personnel wherein a generally cylindrical necked down portion extends between the two gripping portions of the device serving as a restraining portion for a resisting person.

It is a further object of the invention to provide a defensive tool for law enforcement personnel wherein the cylindrical necked down portion of the device is surrounded by a rotatable sleeve or collar to prevent a person from wresting it away from the officer.

It is a major object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENT

Figure 1:
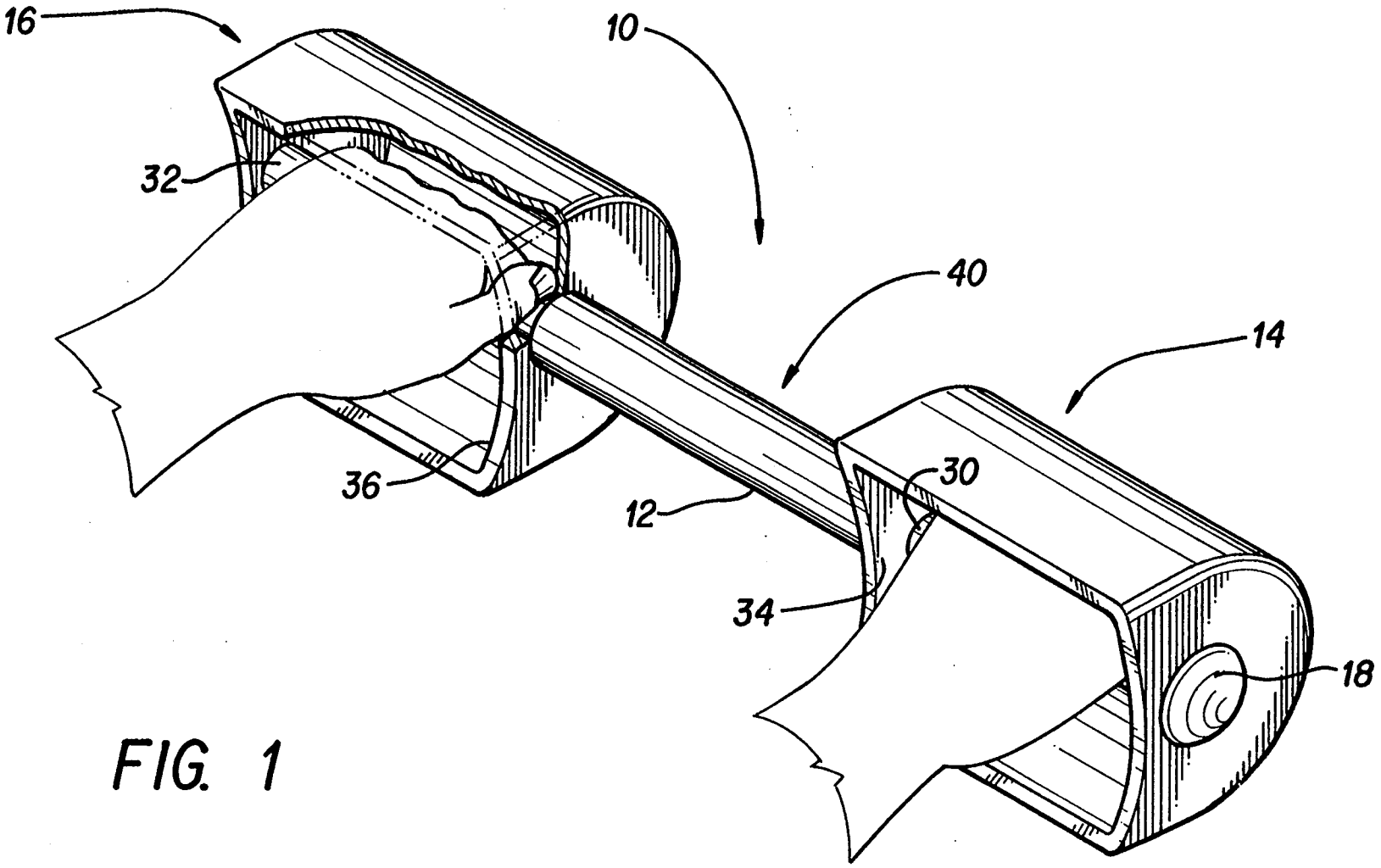
FIG. 1 is an environmental perspective view of the present invention.
Figure 3:
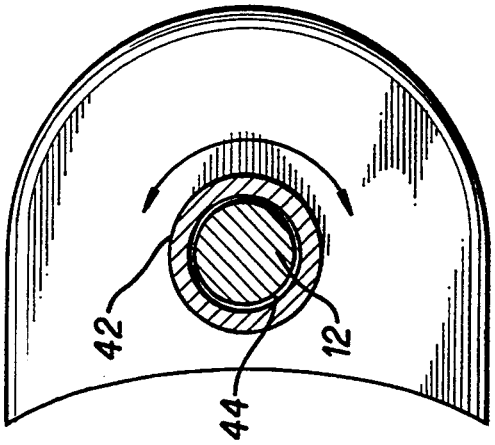
FIG. 3 is a cross sectional view taken along line 3—3 of FIG. 2.

The present invention is seen in FIG. 1 and is generally indicated at 10. The device has a main rod 12, a first grip protector 14, and a second grip protector 16. In the preferred embodiment of the invention, these parts of the unit would be made of a high impact plastic such as is used in football helmets and the like. The main rod extends entirely from one side to the other of the device and terminates in a pair of end caps or knobs 18, 20. The grip protectors 14, 16 can be seen, in the embodiment described herein, to be roughly shaped as hollow half cylinders with closed tops and bottoms, laid on their sides with the main rod 12 passing through each. It should be emphasized that other shapes of grip protectors could be utilized, such as half or partial globes, rectangles, and the like, without departing from the spirit of the present invention. As the main rod 12 passes through the protectors 14, 16, it forms two gripping means or gripping bars 30, 32. These bars 30, 32 are configured such that the hand can easily grasp them. Applicant has ascertained that for proper use, the bars 30, 32 should be held with the thumbs of the user above the bar and proximate to, or resting against, the inner walls 34, 36 of the protectors 14, 16. This provides the user with the greatest transfer of impact shock directly to the palm of the hands, and thus, the upper body.

Figure 2:
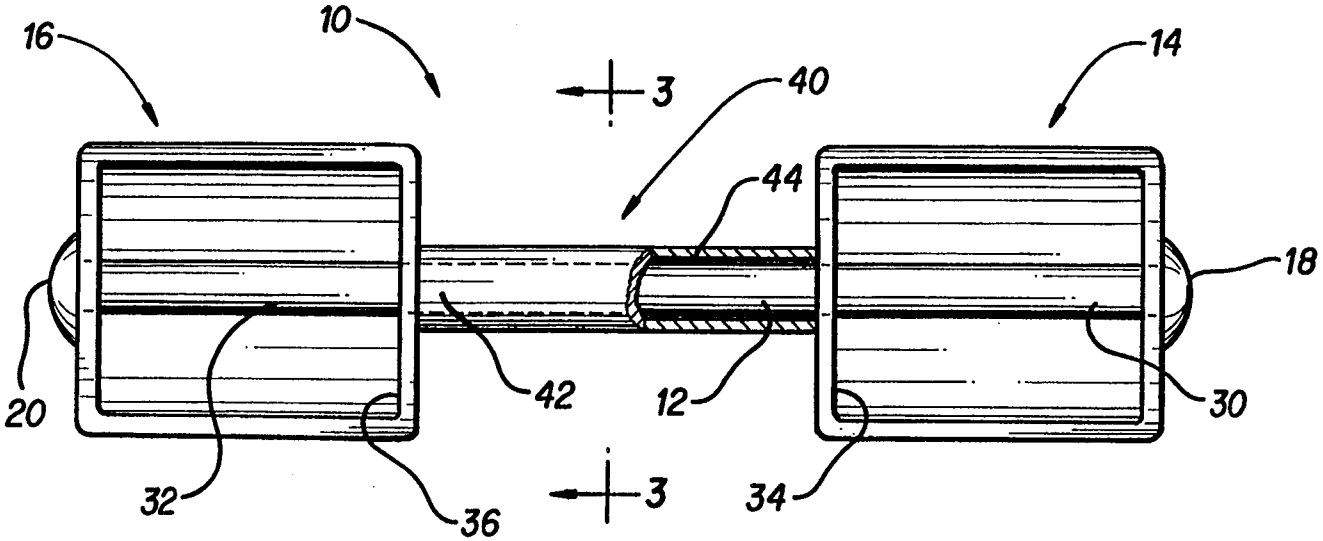
FIG. 2 is a partial cross sectional view of the cylindrical central portion showing the rotatable collar.

Between the protectors 14, 16 is a central portion 40. Referring to FIG. 2, it can be seen that the main bar 12 in this portion is surrounded by a rotatable sleeve 42. This sleeve 42 is preferably made of plastic ABS pipe having a suitable diameter. That the sleeve 42 is rotatable is accomplished by merely providing a sufficient space 44 between the bar 12 and the sleeve 42. Ease of rotation could be increased, of course, by lubrication or bearings (not shown).

In use the device would be gripped as discussed above and the protectors 14, 16 would provide means to ward off an attacker and, also, would provide means to deliver blows to assist in subduing the same. One of the advantages of applicant's present invention is that the blows thus delivered would not have the potential, as do the existing prior art nightsticks and the like, to cripple or seriously injure an apprehendee, especially in the case of blows to the head. Another advantage of the present invention is that of the rotatable sleeve 42 located over the main bar 12 in the central portion 40 of the device 10. If the person with whom the officer was struggling attempted to wrest the device 10 away from the officer, when they grasp the sleeve 42 and attempt to turn the device, their wrist will merely flex, preventing them from developing any leverage or force. Thus, the officer can easily pull the device 10 from their grasp.

Following hereinafter is a list of those elements which were discussed in the specification hereinabove:

| | |
|---|---|
| device | 10 |
| main rod | 12 |
| first protector | 14 |
| second protector | 16 |
| first end cap | 18 |
| second end cap | 20 |
| first grip bear | 30 |
| second grip bar | 32 |
| 1st grip protector inner wall | 34 |
| 2nd grip protector inner wall | 36 |
| central portion | 40 |
| rotatable sleeve | 42 |
| space | 44 |

It is to be understood that the present invention is not limited to the sole embodiment described above, but encompasses any and all embodiments within the scope of the following claims.

I claim:

1. A defensive baton for police officers comprising:

a solid main bar portion having two distal ends with a central portion disposed between said distal ends;

grip means located proximate each of said distal ends, each said grip means comprising a bar integral with said main bar portion and being adapted to be gripped by a human hand;

protective guards disposed proximate each of said grip means, each of said guards comprising a hollow half cylinder closed at each end and having an opening along one side to permit grasping of said bar within said half cylinder, each of the user's hands being substantially covered thereby by said protective guards facing an attacker enabling the user to defend him or her self and disable said attacker; and said central portion of said main bar being covered by a rotatable sleeve extending substantially completely from each of said protective guards to the other, such that said attacker is unable to exert torsional force upon said central portion of said main bar.

* * * * *